US008631769B1

(12) United States Patent
Kirakossian

(10) Patent No.: US 8,631,769 B1
(45) Date of Patent: Jan. 21, 2014

(54) FIRETUBE STEAM BOILER HAVING IMPROVED EFFICIENCY

(75) Inventor: Vague Kirakossian, Thomasville, GA (US)

(73) Assignee: Hurst Boiler & Welding Company, Inc., Coolidge, GA (US)

( * ) Notice: Subject to any disclaimer, the term of this patent is extended or adjusted under 35 U.S.C. 154(b) by 999 days.

(21) Appl. No.: 12/535,535

(22) Filed: Aug. 4, 2009

Related U.S. Application Data

(60) Provisional application No. 61/086,039, filed on Aug. 4, 2008.

(51) Int. Cl.
*F22B 9/06* (2006.01)

(52) U.S. Cl.
USPC ..... 122/75; 122/44.2

(58) Field of Classification Search
USPC ..... 122/44.1, 44.2, 49, 51, 75, 47, 116
See application file for complete search history.

(56) References Cited

U.S. PATENT DOCUMENTS

| | | | | | |
|---|---|---|---|---|---|
| 284,305 | A | | 9/1883 | Jones | |
| 368,306 | A | | 8/1887 | Phelps | |
| 370,206 | A | | 9/1887 | Montgomery | |
| 372,463 | A | | 11/1887 | Greek | |
| 423,787 | A | | 3/1890 | Lyon | |
| 1,166,539 | A | | 1/1916 | Olson | |
| 1,675,724 | A | * | 7/1928 | Petty | 122/51 |
| 2,220,486 | A | | 11/1940 | Krotkov | |
| 2,548,287 | A | * | 4/1951 | Blake, Jr. | 122/75 |
| 2,855,903 | A | * | 10/1958 | Bliss | 122/149 |
| 3,211,134 | A | | 10/1965 | Loebel | |
| 3,241,530 | A | | 3/1966 | Blockley et al. | |
| 3,392,711 | A | | 7/1968 | Wolfersperger | |
| 3,636,724 | A | | 1/1972 | Moy | |
| 3,904,044 | A | | 9/1975 | Lunden | |
| 3,904,046 | A | | 9/1975 | Lunden | |
| 3,904,047 | A | | 9/1975 | Lunden | |
| 3,911,693 | A | | 10/1975 | Seigler et al. | |
| 3,945,125 | A | | 3/1976 | Mouat et al. | |
| 3,978,632 | A | | 9/1976 | Ansted | |

(Continued)

OTHER PUBLICATIONS

Information guide for the Series 45 Low Pressure Firebox Design—Three Pass Firebox Packaged Boilers manufactured by Hurst Boiler & Welding Company, Inc.; 4 pages; published at least as early as Jun. 2003.

(Continued)

*Primary Examiner* — Gregory A Wilson
(74) *Attorney, Agent, or Firm* — Smith Gambrell & Russell LLP

(57) ABSTRACT

An improved boiler for generating steam includes a housing that has a proximal end and a distal end, with a water-entry port at the proximal end. A plurality of firetubes are disposed lengthwise in the housing, and the firetubes extend substantially the length of the housing between the proximal end and the distal end. The firetubes are used to pass the heated flue gas through the housing. A pair of side baffles are affixed to the inner surface of the housing that extend at least partially down the length of the housing to separate a portion of the last pass of firetubes near the housing from the remaining firetubes in the housing. At least two cross-sectional baffles are positioned adjacent the side baffles to direct the flow of water opposite to the flue gas flow in the separated part of firetubes.

11 Claims, 12 Drawing Sheets

(56) References Cited

U.S. PATENT DOCUMENTS

| | | | | | |
|---|---|---|---|---|---|
| 3,982,405 | A | | 9/1976 | Seigler et al. | |
| 3,990,261 | A | | 11/1976 | Smith | |
| 4,014,107 | A | | 3/1977 | Bachrich | |
| 4,057,150 | A | | 11/1977 | Lunden | |
| 4,142,374 | A | | 3/1979 | Ansted et al. | |
| 4,240,378 | A | * | 12/1980 | Caplin | 122/4 D |
| 4,324,521 | A | | 4/1982 | Lunden et al. | |
| 4,330,055 | A | | 5/1982 | Lunden | |
| 4,372,255 | A | * | 2/1983 | Hung | 122/149 |
| 4,384,549 | A | * | 5/1983 | Enga | 122/149 |
| 4,418,649 | A | * | 12/1983 | Purvis | 122/16.1 |
| 4,458,665 | A | * | 7/1984 | Vandervaart | 126/101 |
| 4,627,388 | A | * | 12/1986 | Buice | 122/149 |
| 4,742,920 | A | | 5/1988 | Doherty | |
| 4,801,233 | A | | 1/1989 | Ritola | |
| 4,839,816 | A | | 6/1989 | Cattrall et al. | |
| 4,867,213 | A | | 9/1989 | Bolton et al. | |
| 4,879,659 | A | | 11/1989 | Bowlin et al. | |
| 4,941,901 | A | | 7/1990 | Ramakrishnan et al. | |
| 4,945,797 | A | | 8/1990 | Hahn | |
| 4,945,976 | A | | 8/1990 | Ritola | |
| 4,987,704 | A | | 1/1991 | Johnson et al. | |
| 5,099,896 | A | | 3/1992 | Ritola | |
| 5,138,773 | A | | 8/1992 | Goodwin et al. | |
| 5,148,847 | A | | 9/1992 | Knerr | |
| 5,201,354 | A | | 4/1993 | Weissbeck | |
| 5,205,276 | A | * | 4/1993 | Aronov et al. | 126/109 |
| 5,226,241 | A | | 7/1993 | Goodwin | |
| 5,232,030 | A | | 8/1993 | Knerr et al. | |
| 5,249,915 | A | | 10/1993 | Ritola | |
| 5,320,153 | A | | 6/1994 | Knerr | |
| 5,363,950 | A | | 11/1994 | Lacuna et al. | |
| 5,368,077 | A | | 11/1994 | Croghan et al. | |
| 5,390,778 | A | | 2/1995 | Ritola | |
| 5,437,248 | A | * | 8/1995 | Miura et al. | 122/51 |
| 5,501,256 | A | | 3/1996 | Dyer et al. | |
| 5,505,239 | A | | 4/1996 | Sparks | |
| D373,571 | S | | 9/1996 | Zambelli et al. | |
| 5,579,671 | A | | 12/1996 | Bowlin | |
| 5,622,058 | A | | 4/1997 | Ramakrishnan et al. | |
| 5,623,977 | A | | 4/1997 | Sparks | |
| 5,637,068 | A | | 6/1997 | Chambers | |
| 5,644,392 | A | | 7/1997 | Soest et al. | |
| 5,649,580 | A | | 7/1997 | Mierau et al. | |
| 5,765,617 | A | | 6/1998 | Mierau et al. | |
| 5,775,003 | A | | 7/1998 | Goodwin, III | |
| 5,918,653 | A | | 7/1999 | Knerr | |
| 5,921,206 | A | * | 7/1999 | Sams | 122/367.1 |
| 6,007,295 | A | | 12/1999 | Sears et al. | |
| 6,029,522 | A | | 2/2000 | Schafer et al. | |
| 6,032,564 | A | | 3/2000 | Bowlin | |
| 6,048,164 | A | | 4/2000 | Ritola | |
| 6,062,281 | A | | 5/2000 | Dockter et al. | |
| 6,065,296 | A | | 5/2000 | Feger | |
| 6,092,418 | A | | 7/2000 | Schafer et al. | |
| 6,102,666 | A | | 8/2000 | Albrecht | |
| 6,176,283 | B1 | | 1/2001 | Knerr | |
| 6,178,858 | B1 | | 1/2001 | Knerr et al. | |
| 6,202,526 | B1 | | 3/2001 | Dockter et al. | |
| 6,238,174 | B1 | | 5/2001 | Faerber | |
| 6,276,209 | B1 | | 8/2001 | Schafer et al. | |
| 6,295,907 | B1 | | 10/2001 | Schafer et al. | |
| 6,336,484 | B1 | | 1/2002 | Grenier | |
| 6,367,330 | B1 | | 4/2002 | Schafer | |
| 6,457,363 | B1 | | 10/2002 | Schafer | |
| 6,467,352 | B2 | | 10/2002 | Schafer et al. | |
| 6,564,756 | B1 | * | 5/2003 | Rayes | 122/149 |
| 6,684,705 | B1 | | 2/2004 | Schafer et al. | |
| 2005/0223590 | A1 | | 10/2005 | Erickson | |

OTHER PUBLICATIONS

Information guide for the Feedmiser Feedwater Systems—Packaged Boiler Feedwater Systems manufactured by Hurst Boiler & Welding Company, Inc.; 4 pages; published at least as early as Aug. 2004.

Information guide for the Oxy-Miser Series—Feedwater Deaerators manufactured by the Hurst Boiler & Welding Company, Inc.; 4 pages; published at least as early as Feb. 2003.

* cited by examiner

FIRETUBE STEAM BOILER HAVING IMPROVED EFFICIENCY

CROSS REFERENCE TO RELATED PATENT APPLICATIONS

This application claims priority from U.S. Provisional Application Ser. No. 61/086,039, filed on Aug. 4, 2008, said application being relied upon and incorporated herein by reference.

BACKGROUND OF THE INVENTION

A firetube steam boiler as illustrated in FIG. 1 is commonly known in the art as used for steam generation. A conventional firetube steam boiler 6 may have a Scotch Marine design. The boiler has a closed housing or tank in which water or another fluid is vaporized. The vaporized fluid exits the boiler at saturation temperature for use in various processes or heating applications. Water partially fills a boiler tank or housing with a small volume left above to accommodate steam.

Various heat sources for steam generation may be used, such as a product of combustion of any type of fossil fuel (in a gas, liquid or solid condition) or waste gases of any process. With the first case, different type of burners may be used to perform fossil fuel combustion in the furnace. In the last case, the device for steam production names as a Heat Recovery Steam Generator. Usually (for example, Scotch Marine design) the furnace is immersed in the same water-filled vessel where also the steam generation occurs. Hot flue gas passes are generated in the furnace and pass through tubes (also named as firetubes, because hot flue gas travels inside of the tubes) that extend through the same water-filled closed vessel as furnace.

Water in the vessel of a conventional boiler is always saturated and has an almost uniform temperature through the vessel volume. Usually fresh water enters into the vessel at temperature much less than saturation temperature. However, due to a small ratio of fresh water mass to the mass of water inside of vessel, the temperature uniformity has only local character and does not impact to the heat transfer intensity. The flue gas passes through the furnace and firetubes to an exhaust port, such that the heat transferred by convection and radiation from the flue gas to the saturated water generates steam. The steam then extracts from the top segment of the housing of the boiler for use as desired.

Firetube boilers may include several bundles of firetubes through which the flue gas travels back and forth in the housing. For example, if the boiler includes two bundles of firetubes, the flue gas passes in one direction through a first bundle of firetubes, and then in an opposite direction through the second bundle of firetubes. This is typically referred to as a "three-pass" boiler, since the furnace is used to organize fossil fuel combustion and is considered as a first pass before traveling through the firetubes.

BRIEF SUMMARY OF THE INVENTION

A improved firetube steam boiler is disclosed herein for generating steam using a heat source affixed to the boiler distributing heated flue gas into the boiler. The improved boiler includes a housing that has a proximal end and a distal end, with the housing further having an inner or interior surface and an outer or exterior surface. A water-entry port is positioned at the proximal end and a water outlet port at the distal end. A plurality of firetubes are disposed lengthwise in the housing, and the firetubes extend substantially the length of the housing between the proximal end and the distal end. The firetubes are used to pass the heated flue gas through the housing.

The improved boiler includes a pair of vertical, side baffles that affixed to the inner surface of the housing. The side baffles extend at least partially down the length of the housing, and perhaps the whole length, and separate a portion of said last pass firetubes near the housing from the remaining firetubes in the housing. In addition to the side baffles, the improved boiler will include at least two cross-sectional or substantially horizontal baffles adjacent the side baffles. The horizontal baffles are positioned in the housing between the distal end and the proximal end of the housing, with the horizontal baffles directing the flow of water in said housing from said inlet port proximate the tubes with the coolest gasses to draw or extract the most heat from the coolest tubes.

DESCRIPTION OF THE INVENTION

Figure 1:
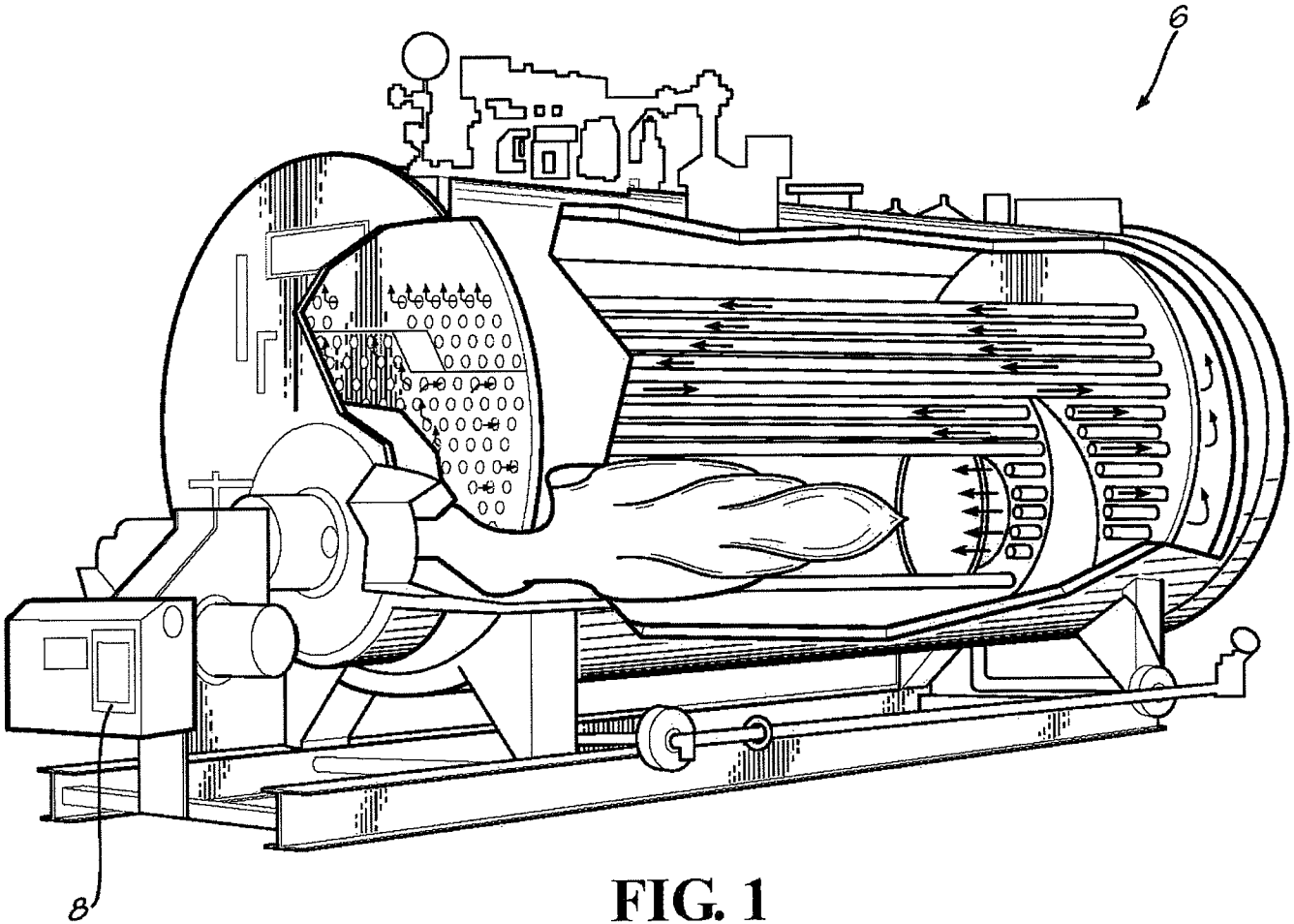
FIG. 1 (PRIOR ART)
FIG. 1 is a perspective cross-sectional view of a four-pass boiler of the prior art.
Figures 2, 2A, 2B, 2C:
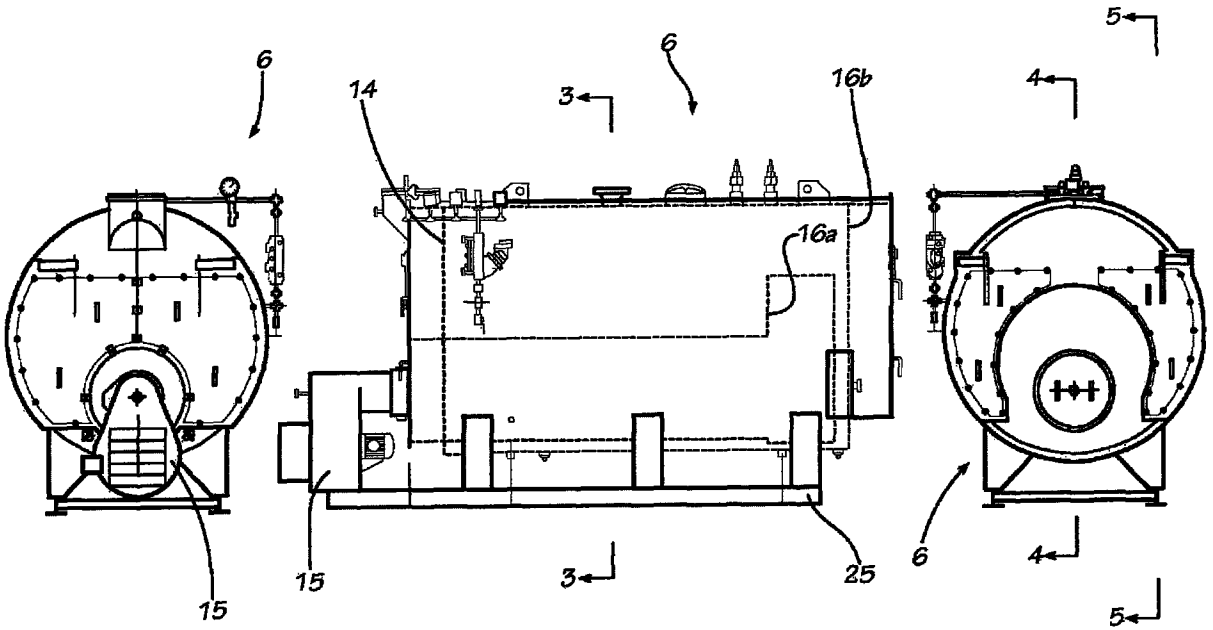
FIG. 2*a* is a front elevational view of a boiler described herein.
FIG. 2*b* is a side elevational view of the boiler illustrated in FIG. 2*a;*
FIG. 2*c* is a rear elevational view of the boiler illustrated in FIG. 2*a;*

Looking to the attached FIGS. 2-5, a four-pass boiler 10 is illustrated having a design to efficiently improve the heating and evaporating of a heat transfer liquid 11, such as water, held in the boiler 10 using heated flue gasses from a furnace 13. The boiler 10 includes a shell or housing 12 having a lateral length between a proximal endplate 14 and distal endplates 16*a* and 16*b*. The housing 12 may have cylindrical shape as illustrated in FIGS. 2*a* and 2*c* and is used to hold the heat transfer liquid 11. The housing 12 is further supported by a frame 25 to securely position the housing 12 on a ground surface.

The boiler 10 includes a means for heating and boiling the liquid 11 which includes a conventional heat source 15 for generating high temperature flue gas (combustion products) into a furnace 13. High temperature flue gas passes through the series of tube-bundles 17, 18 and 19 positioned in the housing (shell) 12 and extending the length of the housing 12 from the proximal endplate 14 to the distal endplates 16*a* and 16*b* (as best shown in FIG. 1). The heat source may be any type known in the art, such as a combustible fuel-fired burner 8 (see FIGS. 2 and 4). In the case of a Heat Recovery Steam Generator, alternative high temperature waste gas from any process may be employed as a heat source.

Figure 3A:
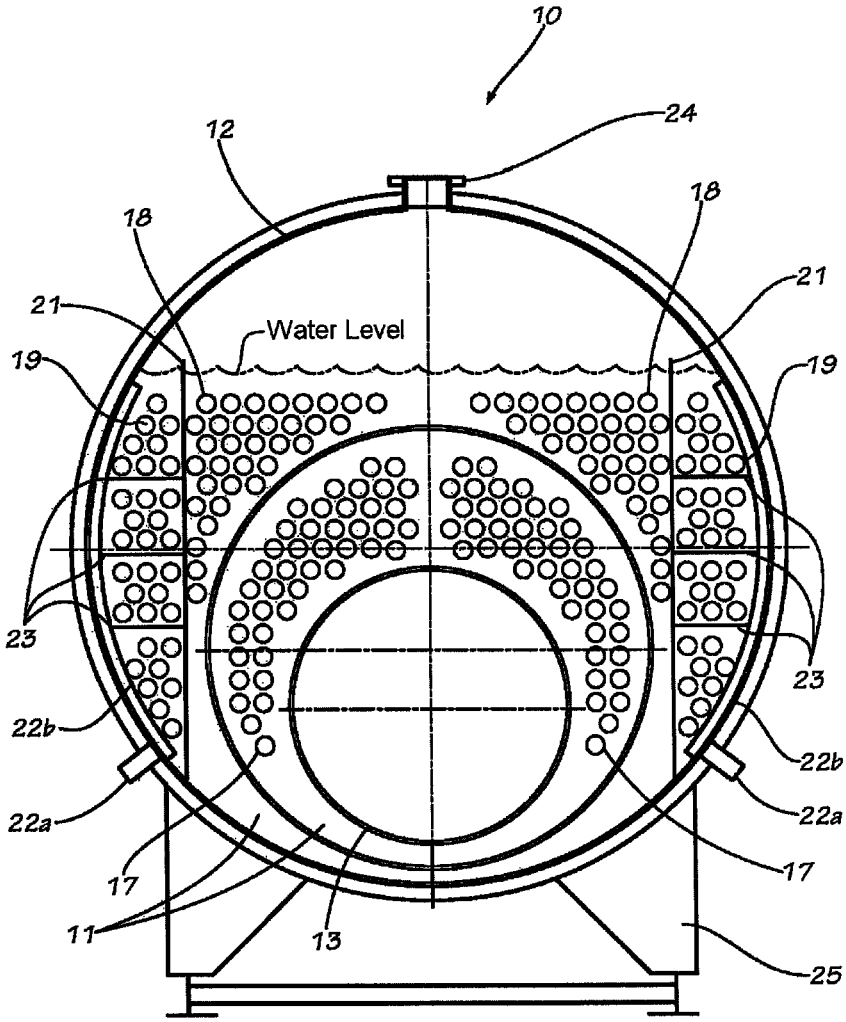
FIG. 3*a* is a front sectional view of the boiler having improved efficiency of FIG. 2*b* taken along lines 3-3.
Figure 4:
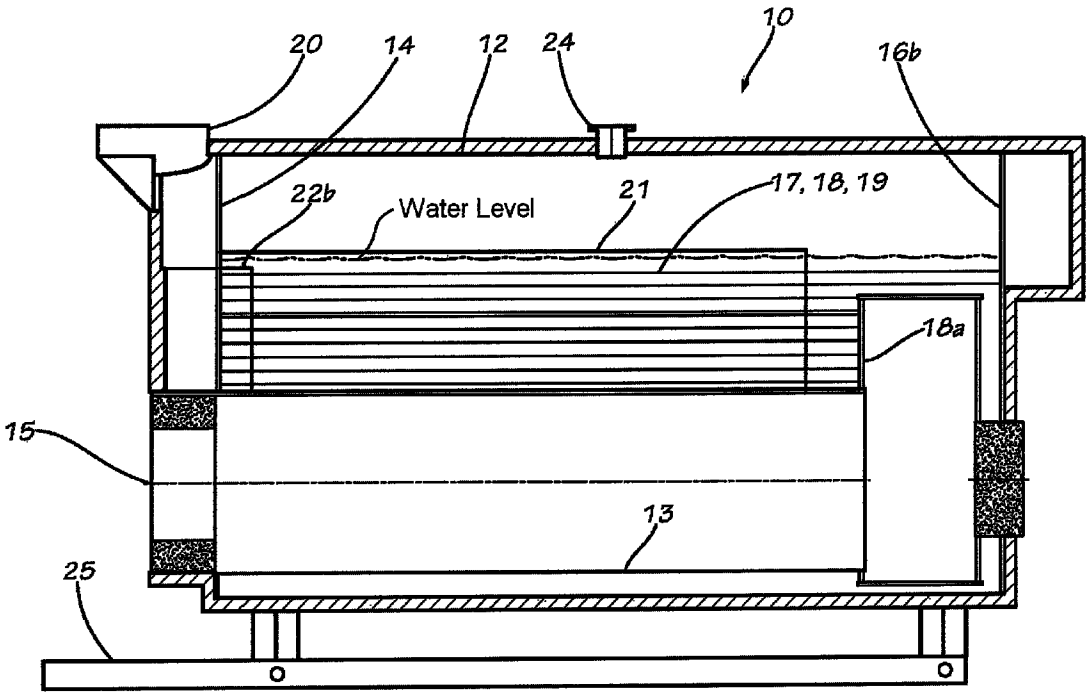
FIG. 4 is a side sectional view of the boiler illustrated in FIG. 2*c* taken along lines 4-4.
Figure 5:
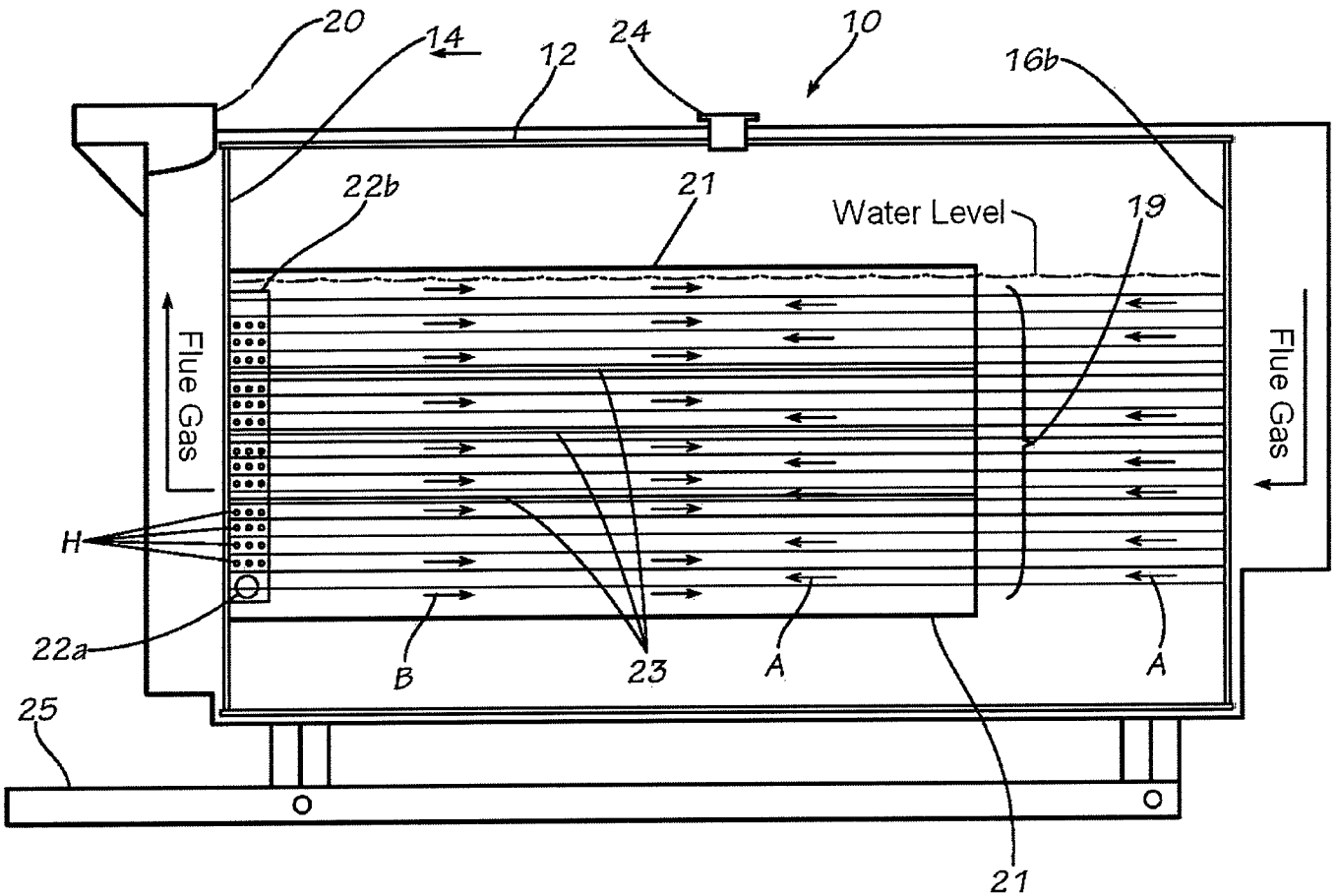
FIG. 5 is a side sectional view of the boiler, the view illustrating the water travel pattern in the boiler illustrated in FIGS. 3 and 4 taken along the lines 5-5.

The tube-bundles 17, 18 and 19, as illustrated in FIGS. 3*a*, 4 and 5, are assembled into three bundles for a four-pass boiler 10. As a result, the flue gas after furnace 13 passes through a first bundle of firetubes 17 in a first direction A from the distal endplate 16*a* to the proximal endplate 14, a second bundle of firetubes 18 in a second direction B from the proximal endplate 14 to the distal endplate 16*b*, in the third bundle of firetubes 19 flue gas travels in the same direction A as in first bundle of firetubes 17. After passing through the third bundle of firetubes 19, the flue gas will be released in an exhaust port 20 located near the proximal endplate 14. Further, the temperature of the flue gas will decrease as the flue gas passes through each set of tubes 17, 18, 19, such that the temperature of the flue gas in the third bundle 19 will be at its lowest temperature before exiting through exhaust port 20.

All of the tube-bundles in a conventional firetube boiler 6 are immersed in water and are not divided by any baffles from each other. So in conventional firetube boiler 6, heat transfers from flue gas to the water at a certain saturation temperature which depends only from pressure in the vessel. The small portion of fresh water mixes with the heated water in the boiler housing, which is a large amount of already saturated water. Further, usually in a conventional boiler there is only an inlet port 22*a* in the middle of the housing. As a result, at the fresh water inlet 22*a* and distribution ports H, the influence of the fresh water on water temperature level in the boiler is negligible. Consequently, the fresh water (in spite of being at much less than saturation temperature) simply loses its ability to extract additional heat from flue gases.

The design of boiler 10 illustrated in FIGS. 2-5 overcomes the lack of conventional boilers by means of organization of fresh water flow in the shell or housing 12 of the boiler 10. With the boiler 10 illustrated in FIGS. 2-5, a pair of side baffles 21 affixed the inside of side-surface of the shell 12 separate the segments of last pass of the third tube bundles 19 from first and second bundles 17 and 18, as well as the other parts of boiler 10 that are immersed or substantially immersed in water in the housing 12. A pair of fresh water input ports 22*a* are positioned near the proximal endplate 14 of the separated segments of housing 12 for supplying of fresh water on opposite sides of the bundles 17, 18, and 19 (flue gas exit from last pass tube-bundles 19). Looking to FIGS. 3*a*-5, a curved distribution baffle (or header) 22*b* is positioned proximate each input port 22*a*, with the distribution baffle 22*b* generally parallel to the housing 12. A series of distribution ports or holes H traverse the length of the distribution baffle 22*b*, and distribute the fresh water from the input port 22*a* into the area between the distribution baffle 22*b* and the substantially vertical side baffles 21. As a result, fresh water runs along the segments between the distribution baffle 22*b* and the side baffles 21 before entering into the main part of housing 12. The baffles 21 allow the coolest fresh water to enter at port 22*a* and flow in direction B, counter to the flue gas flow direction A in the tube bundles 19, before being mixed with saturated water 11 in the housing 12. During the initial flow of water, the temperature of the water is lower (such as 228 degrees Fahrenheit, although it could be less) than within the center of the housing 12.

The design of the boiler 10 provides the greater temperature differential between coolest gasses in the last pass tube-bundles 19 and the fresh water surrounding the tubes 19 due to of organization of counter flow of heat-carrier substances. In other words, the last pass of tube-bundles 19 performs the function of an economizer that is used to capture the lost or waste heat from the hot stack gas of the boiler 6 as used with conventional steam generation systems. However, the economizer is a device that has a separate housing and ductworks in addition to the boiler housing, providing a bulky assembly. In contrast, the design described herein gives the user an opportunity to save on economizer housing, ductwork and boiler room.

The improved boiler 10 will continue to be built as conventional boiler 6 is built, but the last pass tube-bundles 19 (whole or part of tube's length depending the water temperature at the outlet of separated segment) will be separated from other parts of boiler at the outer extremes of the boiler, and the bundles 19 are sandwiched by the cross-sectional or longitudinal, substantially horizontal baffles 23 between the side baffles 21 and the housing 12. So the substantially horizontal baffles 23 do not extend across the whole boiler, but instead extend just from the baffles 21 to the shell 12 of the boiler 10, and further isolate the cooler water from the inlet 22*a* with a smaller portion of the third tube bundles 19 in segments 30*a*, 30*b*, 30*c* or 30*d*.

Figure 3B:
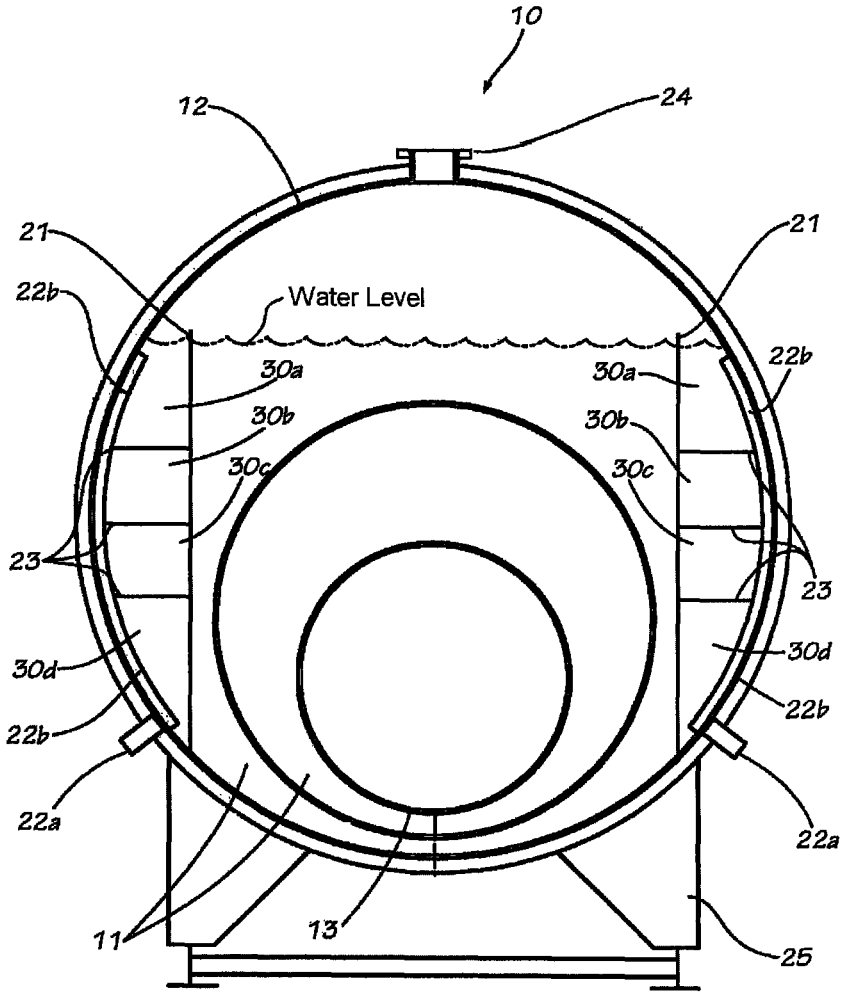
FIG. 3*b* is a second view corresponding to FIG. 3*a*, with the illustrations of the firetubes removed to show the internal baffles.

Looking to FIGS. 3*a* and 3*b*, additional cross-sectional or longitudinal (parallel to the tube bundles 17, 18, 19) internal baffles 23 may be positioned along the length of last pass tube-bundles 19. As a result, as fresh water is introduced at the fresh water inlet 22*a* and distribution ports H (the ports H act as a header for water distribution), the flow of water 11 will be encouraged to flow past the tubes 19 in segments (30*a*, 30*b*, 30*c*, 30*d*) parallel to the tubes 19 before entering into the main body of the boiler housing 12 near the distal endplate 16*b* of the boiler 10. As with conventional boilers, the steam generated in the boiler 10 leaves the housing through the port 24 located on the top of housing 12. This will further organize the third bundles 19 to improve the differential between coolest gasses in the last pass tube-bundles 19 and the fresh water surrounding the tubes 19

The dimensions of the boiler 10 may vary according to the desired use. In the embodiment illustrated, the boiler 10 has a shell 12 diameter of approximately 92 inches, and a length of approximately 167 inches. The diameters of the firetubes 17, 18, and 19 extending through the housing 12 are approximately two and one-half inches each.

Calculations were performed by computer model of this boiler 10 under typical conditions, and it was found that the this design could improve the efficiency of the boiler 10 by as much as three percent or more relative to boilers having traditional designs.

Figure 6:
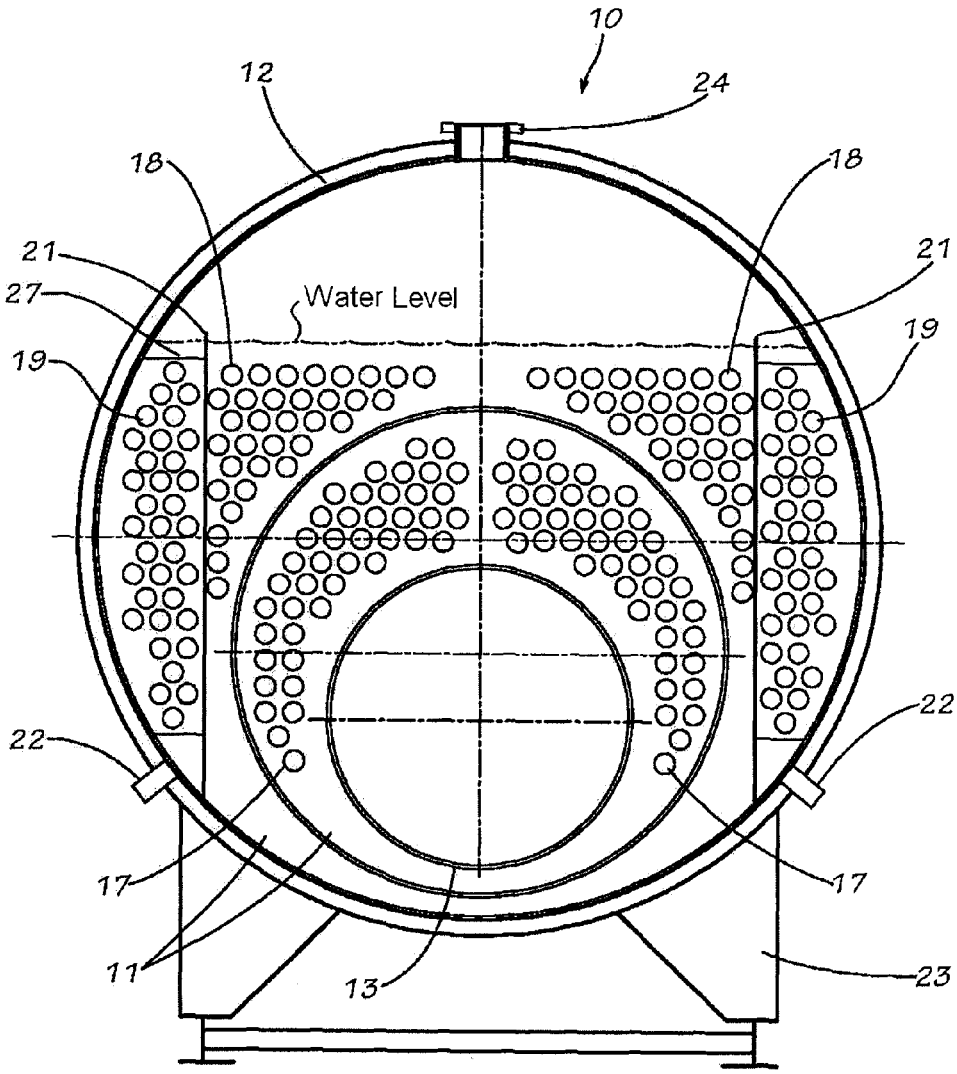
FIG. 6 is a front sectional view of a second embodiment of the boiler having improved efficiency.
Figure 7:
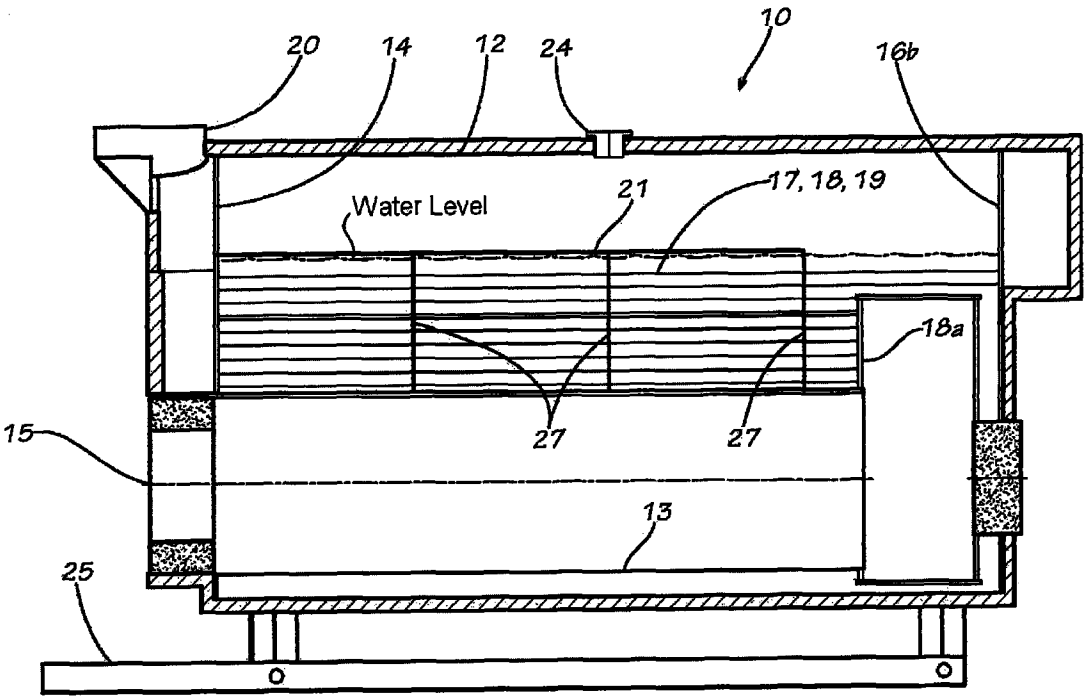
FIG. 7 is a side sectional view of the embodiment illustrated in FIG. 6.
Figure 8:
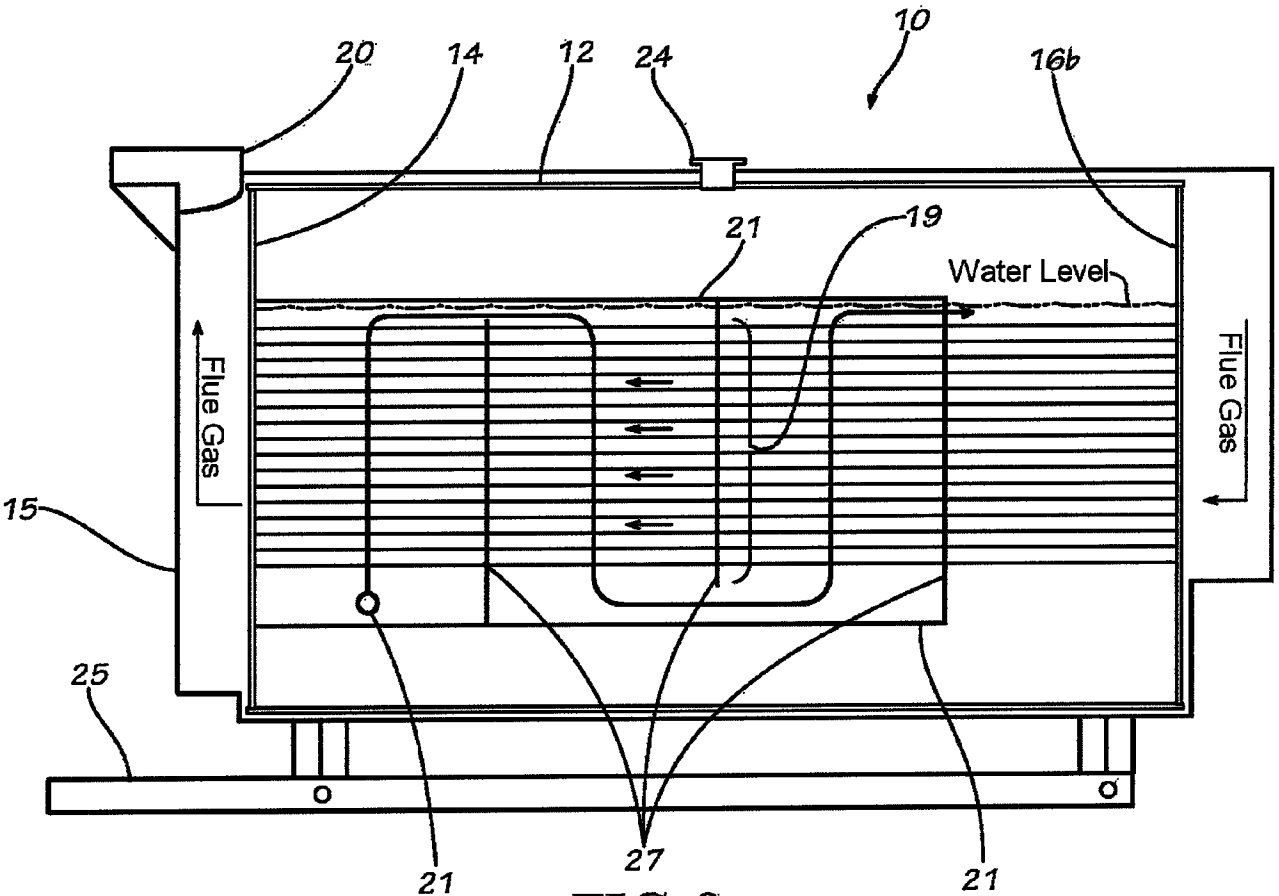
FIG. 8 is a further side sectional view of the embodiment illustrated in FIG. 6.

In a second embodiment of the boiler 10 illustrated in FIGS. 6-8, the boiler 10 overcomes a problem in conventional boilers by means of organization of fresh water flow in the boiler's shell or housing 12. With the boiler 10 illustrated in FIGS. 6-8, the side baffles 21 are affixed the inside of side-surface of the shell 12 and separate the segments of last pass of tube-bundles 19 from other parts of boiler immersed in water in the housing 12. In this embodiment, the baffles 21 have a substantially vertically oriented straight or curved plate that extends longitudinally along at least a portion of housing 12. The fresh water input ports 22 are positioned near the proximal endplate 14 (flue gas exit from last pass tube-bundles 19) of the separated segments of housing 12 for supplying of fresh water. As a result, fresh water runs along of separated segments before entering into the main part of housing 12. The baffles 21 allow the coolest fresh water to flow counter to the flue gas flow direction before being mixed with saturated water 11 in the housing 12.

The boiler 10 will continue to be built as conventional boiler does, but the last pass tube-bundles 19 (whole or part of tube's length depending the water temperature at the outlet of separated segment) will be separated from other parts of boiler at the outer extremes of the boiler 10, and the last pass bundles 19 are sandwiched by cross-sectional internal baffles 27 positioned between the baffles 21 and the housing 12. As a result, the cross-sectional baffles 27 do not extend across the whole shell 12 of the boiler 10, but instead extend just from the baffles 21 to the boiler's shell 12.

The cross-sectional baffles 27 can be positioned at predetermined locations along the length of the housing 12. Looking to FIG. 8, additional cross-sectional internal baffles 27 are positioned substantially equidistantly along the length of last pass tube-bundles 19. The internal baffles 27 are positioned substantially at right angles with respect to the tubes 19, and they are alternately positioned either above or below the upper level of water 11 held in the boiler 10. As a result, as fresh water is introduced at the fresh water ports 22, the flow of water 11 will be encouraged to flow past the tubes 19 in a serpentine fashion before exiting over upper edge of last baffle 27 and entering into the main body of the boiler housing 12 near the distal endplate 16*b* of the boiler 10. Such as in the conventional boiler, the generated in the boiler 10 steam leaves the housing through the port 24 located on the top of housing 12.

It is to be noted that boilers 10 having firetube passes may incorporate the improved efficiency design. Looking to FIGS. 9-11, a third embodiment of the boiler 10 is illustrated corresponding to a 2-pass firetube boiler. In this embodiment, there is a single tube-bundle 19, that is assembled for the two-pass boiler 10 so that the flue gas, after traveling through the furnace 13, will pass in an opposite direction through the bundle of firetubes 19 and be released in an exhaust port 20 located near the proximal endplate 14.

Figure 9:
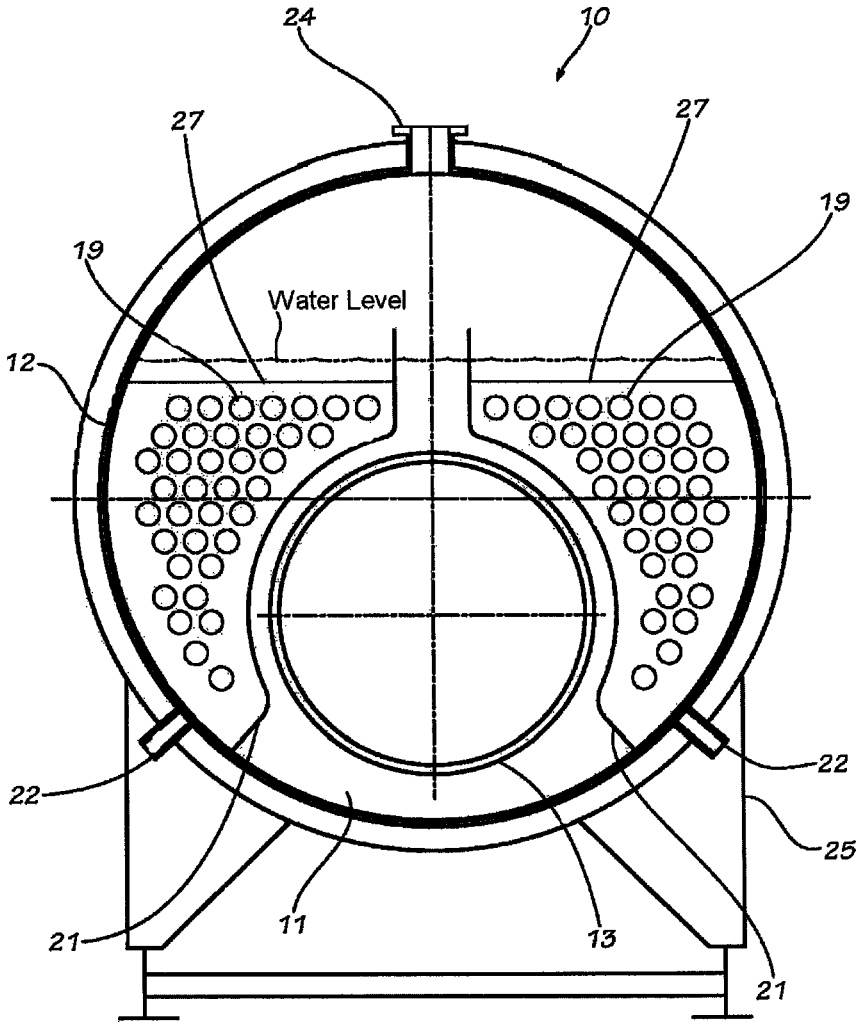
FIG. 9 is a front sectional view of a third embodiment of the boiler having improved efficiency.
Figure 10:
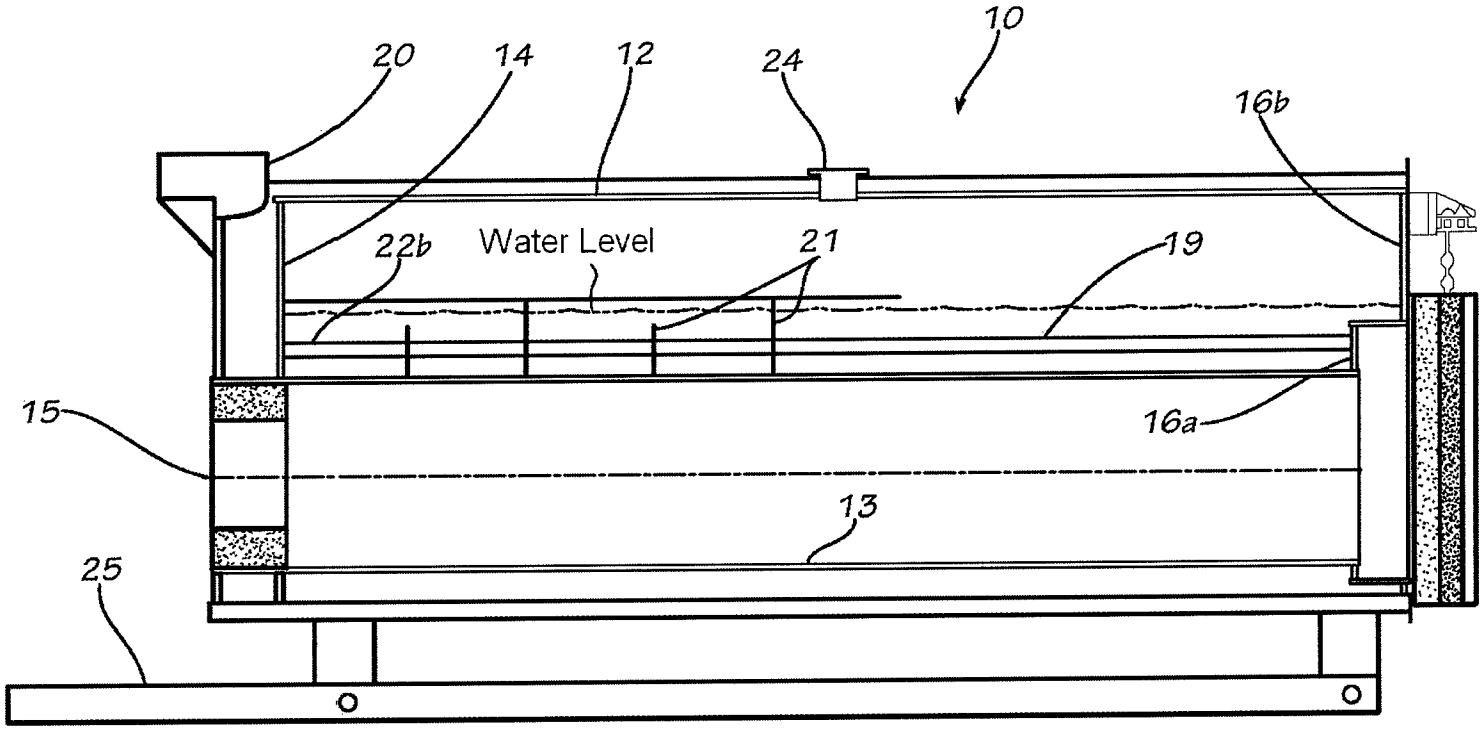
FIG. 10 is a side sectional view of the embodiment illustrated in FIG. 9.
Figure 11:
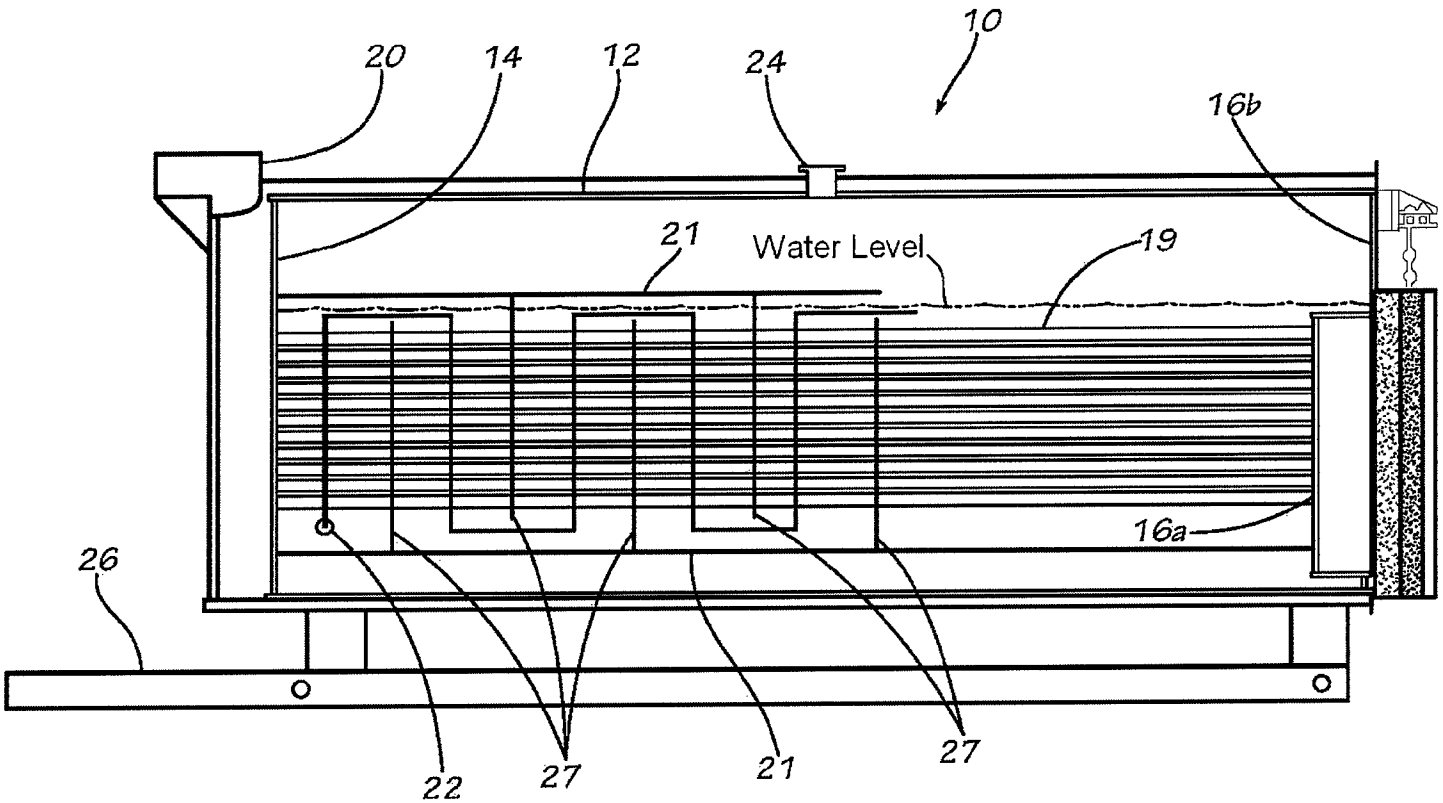
FIG. 11 is a further side sectional view of the embodiment illustrated in FIG. 9.

Like second embodiment, the design of boiler 10 illustrated in FIGS. 9-11 overcomes the lack of conventional boilers by means of organization of fresh water flow in the boiler's shell or housing 12. With the boiler 10 of this embodiment, the a pair of curved or bent substantially longitudinal baffles 21 affixed to the inside of side-surface of the shell 12 separate the segments of last pass of tube-bundles 19 from other parts of boiler immersed in water in the housing 12. Consequently, this embodiment illustrates that the baffles 21 do not have to be substantially straight as illustrated in FIGS. 6-8, but can be bent to best fit around the tube-bundles 19. The fresh water input ports 22 are positioned near the proximal endplate 14 (flue gas exit from last pass tube-bundles 19) of the separated segments of housing 12 for supplying of fresh water. As a result, fresh water runs along of separated segments before entering into the main part of housing 12. The baffles 21 allow the coolest fresh water to flow counter to the flue gas flow direction before being mixed with saturated water 11 in the housing 12. The design of the boiler 10 provides the greater temperature differential between coolest gasses on the last pass tube-bundles 19 and the fresh water surrounded the tubes due to of organization of counter flow of heat-carrier substances.

In this embodiment, cross-sectional internal baffles 27 are positioned substantially equidistantly along approximately half of the length of last pass tube-bundles 19 (see FIG. 6). As with the prior embodiment, the internal baffles 27 are positioned substantially at right angles with respect to the tubes 19, and they are alternately positioned either above or below the upper level of water 11 held in the boiler 10. As a result, as fresh water is introduced at the fresh water ports 22, the flow of water 11 will be encouraged to flow past the tubes 19 in a serpentine fashion before exiting over upper edge of last baffle 27 and entering into the main body of the boiler housing 12 near the distal endplate 16*b* of the boiler 10. Such as in the conventional boiler, the generated in the boiler 10 steam leaves the housing through the port 24 located on the top of housing 12.

Having thus described exemplary embodiments of a FIRETUBE STEAM BOILER HAVING IMPROVED EFFICIENCY, it should be noted by those skilled in the art that the within disclosures are exemplary only and that various other alternatives, adaptations, and modifications may be made within the scope of this disclosure. Accordingly, the invention is not limited to the specific embodiments as illustrated herein, but is only limited by the following claims.

What is claimed is:

1. A firetube steam boiler used for steam generation using a heat source affixed to the boiler distributing heated flue gas into the boiler, the boiler comprising:

a housing having a proximal end and a distal end, the housing having a water-entry port;

a plurality of firetubes disposed in the housing and substantially extending the length of the housing between the proximal end and the distal end, the firetubes passing the heated flue gas through the housing;

a pair of side baffles positioned inside the housing and extending along at least a portion of the length of the housing, the side baffle separating at least a portion of the plurality of firetubes proximate the housing from the remaining firetubes in the housing to define a separated part of the housing; and at least two longitudinal baffles positioned in the separated part of the housing between the distal end and the proximal end of the housing, the longitudinal baffles directing the flow of water opposite to the direction of flue gasses in the separated part of the housing.

2. The boiler as described in claim 1 wherein the side baffles have a substantially flat surface.

3. The boiler as described in claim 1 wherein the side baffles have a curved surface.

4. The boiler as described in claim 1 further comprising two side baffles connected to opposite sides of the housing.

5. The boiler as described in claim 1 further comprising:

at least one distribution baffle proximate said water inlet, said distribution baffle comprising a plurality of distribution ports; and at least one sectional baffle disposed among said second bundle in said housing between the distal end and the proximal end of said housing, said at least one sectional baffle directing the flow of water from said inlet port in said housing.

6. The boiler as described in claim 5 wherein said sectional baffle is substantially horizontal.

7. The boiler as described in claim 1 wherein said side baffle is substantially vertical.

8. The boiler as described in claim 1 wherein the side baffles have a substantially vertically oriented flat surface.

9. The boiler as described in claim 1 wherein the side baffles have a curved vertically oriented surface.

10. A firetube steam boiler used for steam generation using heated flue gas from a heat source, the boiler comprising:

a housing having a proximal end and a distal end, the housing having a water-entry port;

a plurality of firetubes disposed in the housing and substantially extending the length of the housing between the proximal end and the distal end, the firetubes passing the heated flue gas through the housing;

at least one side baffle positioned inside the housing and extending along at least a portion of the length of the housing, the side baffle separating at least a portion of the plurality of firetubes proximate the housing from the remaining firetubes in the housing to define a separated part of the housing; and at least one internal baffle positioned in the separated part of the housing and directing the flow of water opposite to the direction of flue gasses in the separated part of the housing.

11. A firetube steam boiler used for steam generation using heated flue gas from a heat source, the boiler comprising:

a housing having a proximal end and a distal end, the housing having a water-entry port;

a plurality of firetubes disposed in the housing and substantially extending the length of the housing between the proximal end and the distal end, the firetubes passing the heated flue gas through the housing and including a last pass tube bundle;

a side baffle positioned inside the housing and extending along at least a portion of the length of the housing, the baffle separating at least a portion of the last pass tube bundle from the remaining firetubes in the housing to define a separated part of the housing; and a longitudinal baffle positioned in the separated part of the housing and directing the flow of water opposite to the direction of flue gasses in the separated part of the housing.

* * * * *